United States Patent [19]

Hino et al.

[11] 3,946,548

[45] Mar. 30, 1976

[54] BULKY MULTIFILAMENT YARN AND PROCESS FOR MANUFACTURING THE SAME

[75] Inventors: Hajime Hino; Yoshiyuki Sasaki, both of Takatsuki; Yukimasa Fujisawa, Ibaraki, all of Japan

[73] Assignee: Teijin Limited, Osaka, Japan

[22] Filed: July 5, 1974

[21] Appl. No.: 485,834

[30] Foreign Application Priority Data

July 12, 1973 Japan ..... 48-77859
Mar. 2, 1973 Japan ..... 48-24360

[52] U.S. Cl. ..... 57/140 J; 19/.64; 57/34 HS; 57/2; 57/157 TS; 57/157 F

[51] Int. Cl.[2]... D02G 1/02; D02G 3/22; D02G 3/34

[58] Field of Search ..... 57/2, 3, 6, 34 R, 34 HS, 57/34 B, 77.4, 140 R, 140 BY, 140 J, 144, 156, 157 R, 157 TS, 157 MS, 157 F, 160; 28/1.2, 1.3, 1.4, 65, 66; 19/.3, .46, .62, .64

[56] References Cited

UNITED STATES PATENTS

| | | | |
|---|---|---|---|
| 2,077,441 | 4/1937 | Taylor et al. | 57/2 X |
| 3,001,358 | 9/1961 | Mayner | 57/2 X |
| 3,043,088 | 7/1962 | Breen | 57/2 X |
| 3,158,982 | 12/1964 | Marshall | 57/140 BY |
| 3,158,983 | 12/1964 | Tlamicha | 57/157 R |
| 3,732,684 | 5/1973 | Csok et al. | 57/144 X |
| 3,831,360 | 8/1974 | Horvath | 57/2 |
| 3,857,233 | 12/1974 | Cardinal et al. | 57/157 R |

*Primary Examiner*—Donald E. Watkins
*Attorney, Agent, or Firm*—Burgess Ryan and Wayne

[57] ABSTRACT

A multifilament yarn of improved bulkiness is provided. The yarn is composed of two portions, i.e., a relatively dense portion and a blooming, relatively sparse portion, alternately occurring along the length of the yarn. The relatively dense portion is in a partially twisted state and individual filaments in this portion are irregularly entangled and cohere to a greater extent than in the relatively sparse portion. The relatively dense portion has protruding filament ends on the yarn surface in a larger number than the relative sparse portion.

The yarn is prepared by first passing a multifilament yarn through a high velocity fluid jet nozzle and then subjecting it to a combination of the steps of false twisting and frictional contact.

9 Claims, 9 Drawing Figures

BULKY MULTIFILAMENT YARN AND PROCESS FOR MANUFACTURING THE SAME

This invention relates to a continuous filament yarn of increased bulk, which has the same appearance, feel, bulkiness and sweat absorption, as conventional spun yarns of staple fibers, and a process for manufacturing the same from thermoplastic synthetic polymer multifilaments.

Heretofore, many proposals have been made in order to provide a thermoplastic synthetic polymer multifilament yarn with a multitude of fluff, i.e., protruding fiber ends, with the same appearance, feel, bulkiness and sweat absorption, as conventional spun yarn from staple fibers.

For example, one proposal involves applying a twist to a multifilament yarn while the multifilament yarn ballooned in the twist imparting zone is rubbed against a friction member having a sandy surface of inlaid with teasels. Another proposal involves applying a false twist to a multifilament yarn while the multifilament yarn is passed over a friction member such as a rotor with a sandy surface or a rotor inlaid with teasels, in the twist imparting zone.

However, the former proposal is disadvantageous in that, first, the speed of fluffing is limited to a practically unacceptable extent and secondly, the amount of fluff is liable to greatly vary due to the variation in tension, sometimes leading to yarn breakage or undesirable winding around the rotor. The latter proposal is advantageous in that the speed of fluffing is higher, i.e., similar to the speed employed in conventional false twist treatment, and relatively uniform fluff is formed, but is not satisfactory because the multifilament yarn is inevitably cut by the friction member not only at the surface but also partially inside the yarn. Yarn so treated is approximately similar to a yarn composed of staple fibers and is poor in strength. When a larger amount of fluff is desired, the yarn becomes still poorer in strength. Thus, the multifilament yarn is more readily abraded and subject to breakage due to frictional contact with the twister. In addition to poor strength, the fluff, i.e., filament ends protruded from the treated yarn, is readily displaced or slides along the length of the yarn and grows long, resulting in the formation of nep. This yarn is not suitable for further processing into woven or knitted fabric without applying additional twists. Additional twists reduce the bulkiness and softness of yarn as well as being costly.

To sum up, it has been difficult in the past to form stable and uniform fluff on a textured, bulky multifilament yarn.

It is, therefore, an object of this invention to provide a multifilament yarn of increased bulkiness and softness with a multitude of protruding filament ends, the other ends of the filaments being securely gripped inside the yarn, thus preventing the protruding filament ends from sliding along the length of the yarn.

Another object of this invention is to provide a multifilament yarn of the type which, although it is bulky and soft and with a multitude of protruding filament ends, possesses sufficient strength to allow subsequent processing into woven or knitted fabric without additional twists.

Still another object of this invention is to provide a process for manufacturing a multifilament yarn of the above-mentioned type, at an increased speed and without a twisting operation.

Other objects and advantages of this invention will be apparent from the following description.

In one aspect of this invention, there is provided a bulky, crimped thermoplastic polymer multifilament yarn which is composed of two portions, i.e., a relatively dense portion and a blooming, relatively sparse portion, alternately occurring along the length of the yarn and the yarn in said relatively dense portion being in a partially twisted state, and individual filaments in said relatively dense portion being irregularly entangled and cohered with each other to a greater extent than in said relatively sparse portion, and said relatively dense portion having protruding filament ends on the yarn surface in a quantity more than said relatively sparse portion, which protruding filament ends are formed by cutting some or substantially all of the looped and arched filaments on the yarn surface.

In another aspect of this invention, there is provided a bulky, crimped thermoplastic polymer multifilament yarn, which comprises feeding a continuous multifilament yarn having no twist or a twist smaller than approximately 800 turns per meter to a high velocity fluid jet where a multitude of loops and arches are formed on the yarn surface and individual filaments are irregularly entangled with each other. The multifilament yarn is then subjected to a combination of the steps of false twisting such that the whole multifilament yarn is false twisted and of passing the multifilament yarn over a friction member, thereby cutting either a part or the entirety of the looped and arched filaments on the yarn surface to form protruding filament ends.

The "combination" of the steps of false twisting the multifilament yarn and of passing the yarn over the friction member, used herein, means one of three combinations, i.e., the first is that the step of the frictional contact with the friction member is carried out after the step of false twisting, the second is that the step of the frictional contact with the friction member is carried out before the step of false twisting, and the third is that the step of the frictional contact with the friction member is carried out concurrently with the step of false twisting.

The bulky, crimped multifilament yarn of the invention has the following characteristics.

1. The multifilament yarn is false twisted, after it leaves the high velocity fluid jet nozzle where individual filaments are entangled with each other, i.e., in a state such that individual filaments are sufficiently cohered with each other. Therefore, the resulting yarn exhibits improved cohesion and sufficient strength for processing into fabric without introducing substantial twist.

2. The yarn has such improved strength that it can be smoothly and efficiently processed into woven or knitted fabric.

3. The yarn is composed of two distinct portions alternately occurring along the length of the yarn, i.e., the relatively dense portion and the blooming, relatively sparse portion. Therefore, it results in woven or knitted fabric having an artistic effect.

4. The yarn possesses a multitude of protruding filament ends on the surface, which are stable and not readily displaced, do not slide along the length of the yarn and do not grow long.

The multifilament yarn used in the present invention is a continuous multifilament yarn made from a thermoplastic polymer such as, for example, polyester, polyamide, polyolefin or polyacrylonitrile. Number, fineness and various physical and chemical performances of filaments are not critical and may be widely varied depending upon the intended use. It is possible to employ a combination of two or more filaments differing in fineness, cross-sectional shape or physical properties such as tensile strength or shrinkage.

The multifilament yarn used in the present invention should have no twist or, if it has, it should have a twist smaller than approximately 800 turns per meter. If a multifilament yarn possessing a twist exceeding this is used, a multitude of relatively small loops, e.g. two or more loops per centimeter, are not formed when supplied to a high velocity fluid jet, resulting in a yarn having neps and being poor in evenness. Although when said no-twist yarn is employed in the process of the invention, the yarn can be processed at a high speed by the process of the invention and becomes sufficiently strong for processing into fabric without introducing additional twists.

The structure of the yarn of this invention and the process of manufacturing the yarn will be described with reference to the accompanying drawings, in which.

Figure 1:
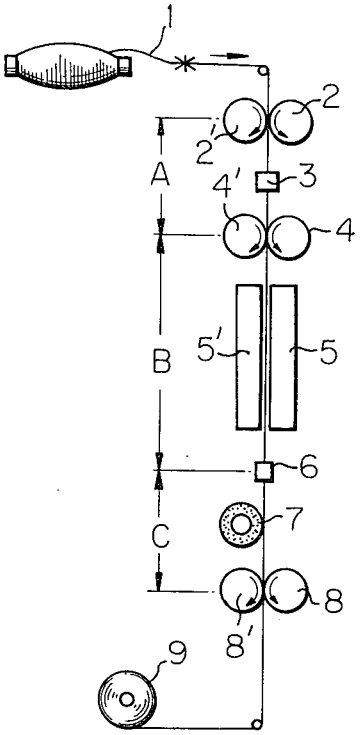
FIG. 1 is a schematic view of a suitable arrangement for practicing the process of the invention.

In FIG. 1, A, B and C designate a high velocity fluid jet treating zone, a false twisting zone and a friction member-contacting zone, respectively. The starting multi-filament yarn 1 may be supplied from any convenient source, such as a yarn package. Alternatively, the yarn may come directly from the spinning process by which it is produced without intermediate wind-up. The yarn is passed via first feed rollers 2 and 2′, arranged to be driven so as to forward the yarn at the desired speed, into a high speed fluid jet nozzle 3 where the individual filaments are separated and entangled with each other and a multitude of relatively small loops and arches are formed on the yarn surface by the turbulence created by the high velocity jet. The yarn is then passed through second feed rollers 4 and 4′ to a false twisting zone B where the yarn is false twisted by a false twist spindle 6 and the false twist is set by heaters 5 and 5′. The yarn is then brought into contact with a friction member 7 such as a roller or rotor having a sandy surface or inlaid with teasels, positioned in the untwisting zone C, where some or substantially all of the looped and arched filaments are cut predominantly on the yarn surface to form protruding filament ends.

Finally, the yarn is passed via take-up rollers 8 and 8′ to a winding apparatus 9.

Figure 9:
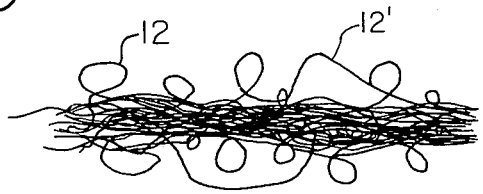
FIG. 9 is a side view showing the appearance of a yarn leaving the high velocity fluid jet.

The yarn leaving the high velocity fluid jet has a structure such that individual filaments are entangled and a multitude of loops 12 and arches 12′ are formed on the yarn surface, as shown in FIG. 9. This structure can be controlled, for example, by the rate at which the yarn is passed through the jet, by the pressure of fluid and by the amount of overfeed.

The percent of overfeed is the percent by which the speed of yarn feed to the jet 3, i.e., the peripheral speed of the first feed rollers 2 and 2′, exceeds the speed of yarn take-up, i.e., the peripheral speed of the second feed rollers 4 and 4′, and is calculated from the following equation:

$$\text{Percent of overfeed} = [(v_1 - v_2)/v_2] \times 100$$

where $v_1$ = peripheral speed of first feed rollers 2 and 2′

$v_2$ = peripheral speed of second feed rollers 4 and 4′.

The amount of overfeed should preferably be within the range of 5 percent to 25 percent, and more preferably 5 percent to 15 percent depending upon the effect desired.

In general high pressure air is employed as the fluid jet. The pressure of air supplied to the jet nozzle 3 may be varied within the range of 2 to 7 kg/cm$^2$. However, in order to obtain adequate strength which will permit the weaving or knitting of the resulting yarn into fabrics, relatively high pressure, e.g. higher than 3 kg/cm$^2$, is preferred.

The conditions under which the yarn leaving the jet nozzle 3 is false twisted may be approximately similar to those employed in a conventional false twist procedure for texturing multifilament yarns. The number of twists may be as large as possible, and is usually selected within the range defined by the following equation:

$$\text{Number of twists, in turns per meter} = 32500/\sqrt{D} \times \alpha$$

where

D = fineness of multifilament in denier, $\alpha$ = coefficient varying depending upon the type of multifilament. For example, the coefficient $\alpha$ is 0.6 to 1.0 for polyester multifilaments.

The temperature at which the false twisted yarn is heated, i.e., the temperature of heaters 5 and 5′, may be varied depending upon the particular multifilament. For example, 215°C to 220°C are preferable for polyester multifilaments.

The relative speed of the second feed rollers 4 and 4′ to the take-up rollers 8 and 8′ should preferably be such that the yarn leaving the false twist spindle 6 and which is then passed to the friction member 7 is under a tension of 0.2 g/denier to 0.5 g/denier. The percent of overfeed, i.e., the percent by which the peripheral speed of second feed rollers 4 and 4′ exceeds the peripheral speed of take-up rollers 8 and 8′ is preferably within the range from −5 percent to 5 percent.

The friction member 7 may be a roller or rotor or another suitable form, and usually possesses a sandy surface provided by coating it with emery or carborundum particles. The friction member may be a metal file or inlaid with teasels. A preferable friction member is a rotor having a sandy surface. The sandy rotor is most preferably covered by emery or carborundum particles with sizes, graded as "medium" (No. 30 to No. 60 according to the Japanese Industrial Standard) and "fine" (No. 80 to No. 600 according to the same standard). The direction of rotation of the friction rotor may be the same as or the reverse of that of the yarn.

Figure 2:
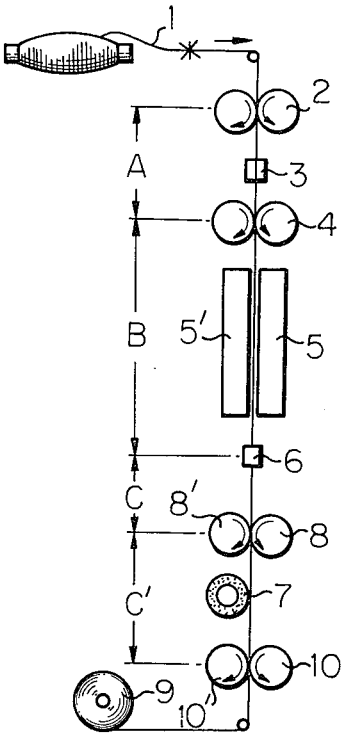
FIG. 2 is a schematic view of a version of the arrangement shown in FIG. 1.

FIG. 2 is a version of the arrangement shown in FIG. 1. In FIG. 2, C and C′ designate an untwisting zone and a friction member contacting zone, respectively. The yarn is brought into contact with the friction member 7 placed between first take-up rollers 8 and 8′ and second take-up rollers 10 and 10′.

As a modified embodiment of that shown in FIG. 2, the yarn may be brought into contact with the friction member after the yarn is once wound by the winder 9 i.e., in the course of being rewound into cones or pirns, although it is not shown in the drawings.

Figure 3:
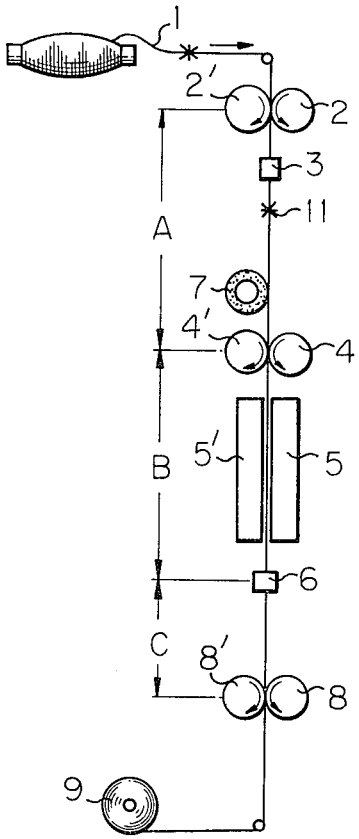
FIG. 3 is a schematic view of another version of the arrangement shown in FIG. 1.

FIG. 3 is another version of the arrangement shown in FIG. 1. In FIG. 3, the friction member is positioned between the high velocity fluid jet nozzle 3 and the second feed rollers 4 and 4′. Numerical reference 11 designates a tension controlling means.

Figure 4:
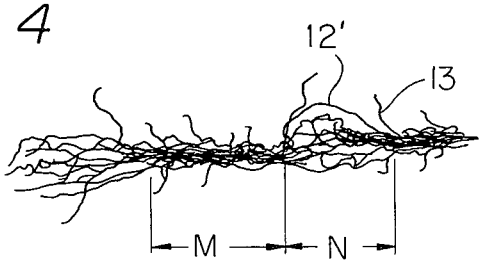
FIG. 4 is a side view showing the appearance of a yarn treated in the apparatus shown in FIG. 1.

The yarn treated in the process of the invention illustrated above in reference to FIGS. 1 and 2 has an appearance as shown in FIG. 4. The yarn is composed of two distinct portions, i.e., a relatively dense portion M and a blooming, relatively sparse portion N, both alternately occurring along the length of the yarn. Each said portion M is in a partially twisted state, and individual filaments in this portion are irregularly entangled and cohere with each other to a greater extent than in said portion N. There are a multitude of protruding filament ends 13, which have been formed by cutting loops and arches on the yarn surface, although a relatively small number of loops 12 and arches 12′ remains. The length of the filament ends protruding from the yarn surface is relatively short, uniform and stable. Said portion M has more protruding filament ends and loops and arches than said portion N.

The yarn partially possesses crimps in a form similar to those of conventional false twisted crimped yarn and is very bulky as compared with conventional spun yarns from staple fibers. The length of each said portion M usually varies within the range of 0.5 cm to 3.0 cm and the length of each said portion N is usually less than the length of the relatively dense portion. The two types of portions in general occur at irregular intervals.

Figure 5:
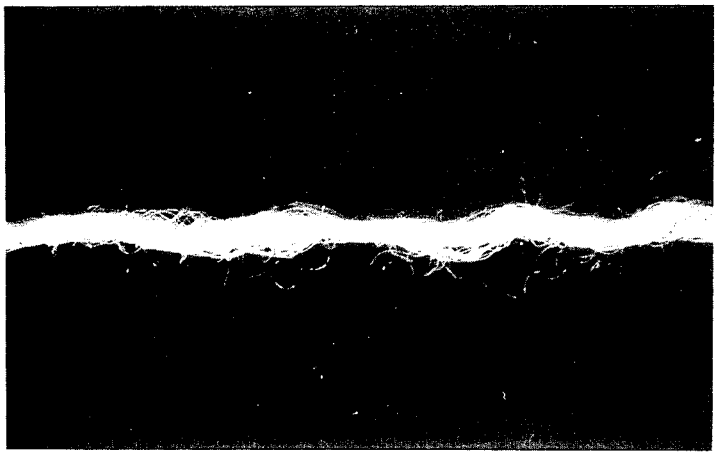
FIG. 5 is a photomicrograph of a relative dense portion of the yarn shown in FIG. 4.
Figure 6:
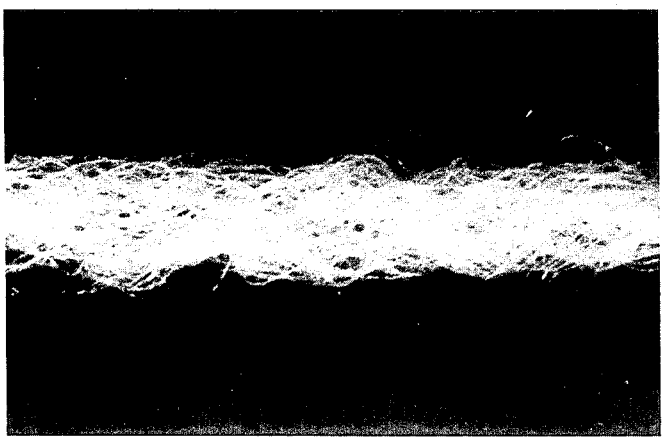
FIG. 6 is a photomicrograph of a blooming, relative sparse portion of the yarn shown in FIG. 4.

Microphotographs shown in FIGS. 5 and 6 illustrate the partially untwisted portion M and portion N, respectively. It will be apparent that said portion N possesses a configuration similar to that of conventional false twisted multifilament yarn.

The multifilament yarn treated by the process set forth with reference to FIGS. 1 and 2 is characterized as possessing uniform and relatively short fluff, i.e., protruding filament ends. This is because the looped and arched filaments are firmly interlocked at the non-looped and non-arched portions inside the yarn by the heat treatment in the course of false twisting, and therefore, when the yarn is brought into contact with the friction member, the protruding filament ends formed therefrom neither slide along the length of the yarn nor grow long.

In contrast, in the case where a multifilament yarn is first false twisted and then passed through a high velocity fluid jet nozzle as disclosed in Japanese Patent Publications 8364/63 and 9175/64, and then brought into contact with the friction member, the following disadvantages are observed. First, since the yarn brought into the contact with the frictional member possesses undesirably enhanced stretchability, the operation of frictional contact with the friction member cannot be well performed, and the protruding filament ends grow very long and are readily displaced and slide along the length of the yarn. This yarn is of little or no practical use. Secondly, even if the operation of the frictional contact is carried out under an increased tension so that the enhanced stretchability is controlled, neither desired quantities nor uniform protruding filament ends are formed. This is because the looped and arched filaments are not heat treated after once being formed, and the loops and arches are liable to readily disappear under increased tension. Thirdly, since loops and arches are formed after the yarn is heat treated in the false twisting step, the looped and arched filaments are not sufficiently locked inside the yarn and readily disappear. Thus, it is difficult to perform well the frictional contact with the frictional member and to form uniform protruding filament ends.

According to the process of the present invention, the looped and arched filaments are liable to be partially cut predominantly at the blooming, relatively sparse portion when brought into contact with the friction member, and the protruding filament ends formed are displaced or slide to the relatively dense portion only to a minor extent. Thus, the relatively dense portion has protruding filament ends on the yarn surface in a larger number than the blooming, relatively sparse portion.

Figure 7:
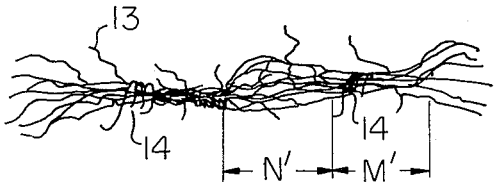
FIG. 7 is a side view showing the appearance of a yarn treated in the apparatus shown in FIG. 3.
Figure 8:
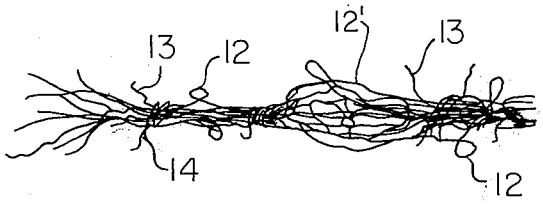
FIG. 8 is a side view showing the appearance of another yarn treated in the apparatus shown in FIG. 3.

The yarn treated in the process of the invention illustrated in reference to FIG. 3 has the appearance as shown in FIGS. 7 and 8. The yarn is composed of two distinct portions, a relatively dense portion M′ and a blooming, relatively sparse portion N′, both alternately occurring along the length of the yarn, which are similar to those in the yarn illustrated in reference to FIGS. 4, 5 and 6. However, the relatively dense portion M′ is characterized by the presence of filaments 14 coiling round the yarn. Due to the presence of said filaments 14, the yarn has improved cohesion, and the protruding filament ends do not slide along the length of the yarn and the protruded filaments are uniform in length.

The yarn shown in FIG. 7 possesses a multitude of protruding filament ends 13 but little or no loops and arches on the yarn surface. In contrast, the yarn shown in FIG. 8 possesses relatively large numbers of protruding filament ends 13 and loops 12 and arches 12′ on the yarn surface. These two yarns of FIGS. 7 and 8 are prepared by cutting, in the step of frictional contact with the friction member, either all or some of the loops and arches formed by the high velocity fluid jet treatment, respectively. The relative number of the protruding filament ends to the loops and arches may be varied depending upon the intended use. In general the number of the protruding filament ends is preferably larger than 30 per meter. The larger the number of the protruding filament ends, the more downy and bulky the yarn and the fabric therefrom. In contrast, when the loops and arches are large in number, the yarn exhibits improved cohesion, and undesirable displacement and sliding of the protruding filament ends along the length of the yarn can be avoided or minimized. This makes it easier to weave or knit the yarn into fabrics.

It is possible to supply two or more different multifilaments at the same time to the first feed rollers thereby to manufacture a composite bulky yarn. Multifilament yarns of different polymers result in fabrics of unique bulkiness and touch and, in some cases, exhibit a color mixing effect due to the difference in dyed color. Multifilament yarns different in fineness or cross-sectional shape result in fabrics superior in luster as well as bulkiness.

It is also possible to supply two or more different multifilament yarns at different speeds thereby to prepare a composite yarn comprising a multifilament core and a far greater number of protruding filament ends on the yarn surface. It is also possible to prepare a composite yarn comprising two types of portions, i.e., one having protruding filament ends and the other having no protruding filament ends, both occurring alternately along the length of the yarn.

When two or more multifilament yarns having different melting points are employed, and the composite yarn is heated at a temperature approximating the melting point of the yarn having the lowest melting point by the heater in the false twist process, the resulting yarn exhibits a structure like a hard twisted yarn. A part of the filaments melting at a lower temperature is adhered to the other filaments when heated, and the adhered portions remain substantially untwisted. Thus, these portions and the relatively dense, partially untwisted portions provide the structure set forth above. This yarn provides a fabric like georgette.

The yarn treated in the process of the present invention may be heat treated before processing into fabrics. The distinction between the relatively dense portion and the blooming, relatively sparse portion becomes somewhat obscure, i.e., the yarn attains a straight, uniform structure, because of the additional heat treatment. This yarn provides knitted fabrics with stitches which are uniform and of an attractive appearance. When a heater of the type with which the yarn is directly in contact is employed, fluff binding can be effected.

A multifilament yarn of very small denier may be treated in the process of the present invention. Thus, a very fine bulky yarn can be produced with enhanced productivity and without yarn breakage. This is in marked contrast to the conventional technique of spinning staple fibers into fine spun yarn.

The process and products of the invention will now be illustrated by the following examples, which are not to be construed as limiting the scope of the invention.

EXAMPLE 1

Using an apparatus, as shown in FIG. 1, a polyester multifilament yarn of 150 den./72 fil., having a twist of 10 turns/meter was processed under the following conditions:

| | |
|---|---|
| Feed speed | 100 m/min |
| First overfeed* | 10% |
| Air pressure | 5.5 kg/cm² |
| Second overfeed** | 0% |
| False twist | 2,500 t/m |
| Rate of rotation of the spindle | 250,000 rpm |
| Temperature of the heater | 220°C |
| The frictional member | 200 mesh carborundum rotor |
| Rate of rotation of the frictional member | 3,600 rpm |

*% overfeed by the first feed rollers 2, 2' to the nozzle 3.
**% overfeed by the second feed rollers 4, 4' to the take-up rollers 8, 8'.

The textured yarn so obtained has an appearance, as shown in FIG. 4, in which partly twisted, relatively compact crimped portions M having an average length of 8 mm as shown in FIG. 5, and blooming crimped sparse portions N having an average length of 6 mm, as shown in FIG. 6, were observed alternately along the axis of the yarn. The number of protruding filament ends 13 in the portions M was 6.1 ends/cm on an average, with an average length for fibers of 6 mm and of maximum length of 10 mm, while the number of protruding filament ends 13 in the portions N was 2.5 ends/ cm on an average, with an average length for fibers of 12 mm and a maximum length of 16 mm. The product was a bulky crimped yarn having filament ends and giving a soft and downy feel.

Loops 12, having as few as 0.5 loops/cm on average, were found in the product of this example.

EXAMPLE 2

Using an apparatus, as shown in FIG. 1, a polyamide multifilament yarn of 40 den./34 fil., having a twist of 13 turns/meter was processed under the following conditions:

| | |
|---|---|
| Feed speed | 60 m/min |
| First overfeed | 8% |
| Air pressure | 5 kg/cm² |
| Second overfeed | 1.5% |
| False twist | 3,330 t/m |
| Rate of rotation of the spindle | 200,000 rpm |
| Temperature of the heater | 175°C |
| The frictional member | 250 mesh carborundum rotor |

A bulky crimped yarn having protruding filament ends was obtained, which had an appearance similar to that of the product obtained in Example 1 but was finer. The yarn was comprised of partially twisted crimped portions M having an average length of 4 mm and blooming portions N, having an average length of 10 mm, said portions M and N alternately occurring along the axis of the yarn. The number of protruding filament ends of the yarn was 4 ends/cm on an average, with an average length of fiber ends of 7 mm and a maximum length of 11 mm.

Using the yarn obtained in this example, a tricot fabric was knitted, which presented a pleasant feel to the skin.

EXAMPLE 3

Following the procedure described in Example of Japanese Patent Publication No. 8122/61, a filamentary core yarn was prepared by feeding to a nozzle a polyester multifilament yarn of 75 den./24 fil., having a twist of 10 turns/meter at a rate of 70 m/min, to form a core and concurrently overfeeding to the same nozzle a polyester multifilament yarn of 75 den./36 fil., having a twist of the same order under little or no tension to form a sheath. The yarn so produced was then processed on the apparatus, under the conditions described in Example 1. The textured yarn so obtained was a bulky crimped yarn having protruding filament ends which, when compared with the products obtained in Examples 1 and 2, contained partially twisted crimped portions M in a large proportion and had long protruding filament ends an average length of 12 mm and a maximum length of 17 mm with a density of 8.2 ends/cm on average. The yarn was comprised of partially twisted crimped portions having an average length of 20 mm and blooming crimped portions N having an average length of 5 mm, said portions M and N alternately occurring along the axis of the yarn.

COMPARATIVE EXAMPLE

Using a false twist polyester multifilament yarn of 100 den./48 fil., having an S twist of 100 turns/meter, the processes described in Japanese Patent Publication Nos. 8364/63 and 9175/64 were respectively carried out, and in each case the processed yarn was treated with a 200 mesh carborundum rotor which was provided downstream from the nozzle and driven at a rate of 3,600 rpm.

In all runs, except the run in which the process was carried out in the manner as illustrated in FIG. 1 of the Publication No. 8364/63, the yarn speed and the yarn tension downstream of the nozzle were unstable and yarn breakage frequently occurred, thus making the processing of yarn extremely difficult. In the run wherein the process was carried out in the manner as illustrated in FIG. 1 of the Publication No. 8364/63, the yarn could be processed at a relatively slow processing speed. However, the product obtained has a loose structure having very long protruding filament ends which were readily displaced along the axis of the yarn, or insufficiently locked in position.

EXAMPLE 4

Using an apparatus, as shown in FIG. 3, a polyester multifilament yarn of 150 den./72 fil., having a twist of 13 turns/meter was processed under the following conditions:

| | |
|---|---|
| Feed speed | 100 m/min |
| First overfeed | 15% |
| Air pressure | 3.5 kg/cm² |
| Second overfeed | −2% |
| False twist | 2,400 t/m |
| Rate of rotation of the spindle | 110,000 rpm |
| Temperature of the heater | 220°C |
| The frictional member | carborundum rotor (JIS No. 60) |

Rate of rotation of the frictional member 3,600 rpm

Some properties of the products are shown in Table I, together with those of a crimped yarn prepared by the conventional false twist technique from a polyester multifilament yarn of 150 den./72 fil., having a twist of 13 turns per meter (Control 1).

Table I

| | Example 4 | Control 1 |
|---|---|---|
| Tensile strength (g/den.) | 2.5 | 4.2 |
| % of crimping | 12 | 14 |
| Number of protruding filament ends per cm | 10 | 0 |
| Number of loops per cm | 6 | 0 |
| Average length of protruding filament ends (mm) | 3.7 | — |
| Number of coils per cm*[1] | 0.3 | 0 |

*[1]Number of coils of filaments which coil around the portion M.

EXAMPLE 5

Using an apparatus, as shown in FIG. 3, a polyester multifilament yarn of 150 den./76 fil., having an S-twist of 600 turns/meter was processed under the following conditions:

| | |
|---|---|
| Feed speed | 75 m/min |
| First overfeed | 15% |
| Air pressure | 4.5 kg/cm² |
| Second overfeed | 2% |
| False twist | 2,000 t/m |
| Temperature of the heater | 220°C |
| The frictional member | 120 mesh carborundum rotor |

The textured yarn so obtained had an appearance like a spun yarn from staple fibers, as shown in FIG. 8. The relatively compact crimped portions M′ had an average length of 28 mm and the blooming, relatively sparce crimped portions N′ had an average length of 5.3 mm. Tensile strength, percent of crimping, average length of protruding filament ends, number of coils per cm and number of loops per cm were 2.8 g/den., 10.5 percent 5.3 mm, 0.5 and 12.3, respectively.

EXAMPLE 6

Using an apparatus, as shown in FIG. 3, a polyester multifilament yarn of 150 den./72 fil. substantially free from any twist was processed under the conditions described in Example 4.

The resultant textured yarn exhibited tensile strength of 2.5 g/den. with a percent of crimping of 12 percent, and contained 11.5 protruding filament ends/cm on an average with an average length of fibers of 6.5 mm, 4.6 loops per cm on an average and 0.4 coils of filament on an average.

EXAMPLE 7

Using an apparatus, as shown in FIG. 3, a polyester multifilament yarn of 150 den./72 fil. having a twist of 13 turns per meter was processed under the conditions as described in Example 4, except that the frictional member was replaced by a coarser carborundum rotor (JIS No. 30) driven at 4,500 rpm so as to obtain a product substantially free from loops and curls and a second overfeed of −5 percent was used instead of −2 percent. Tensile strength, percent of crimping, number of protruding filament ends per cm of the yarn, number of loops per cm of the yarn and number of coils per cm of the yarn were 2.0 g/den., 12 percent, 25 ends/cm (the average length of fibers being 8 mm), 0.2 loop/cm and 0.5 coils/cm, respectively.

EXAMPLE 8

Using an apparatus, as shown in FIG. 3, a polyester multifilament yarn of 40 den./24 fil. having a twist of 10 turns per meter was processed under the following conditions:

| | |
|---|---|
| Feed speed | 55 m/min |
| First overfeed | 10% |
| Air pressure | 2.5 kg/cm² |
| Second overfeed | 3% |
| False twist | 3,500 t/m |
| Rate of rotation of the spindle | 110,000 rpm |
| Temperature of the heater | 220°C |
| The frictional member | carborundum rotor (JIS No. 120) |
| Rate of rotation of the frictional member | 3,600 rpm |

A textured yarn which had an appearance similar to that of the yarn prepared in Example 4 but was finer, was obtained.

EXAMPLE 9

Using an apparatus, as shown in FIG. 3, a polyester multifilament yarn of 75 den./24 fil. having a twist of 15 turns per meter and a polyamide multifilament yarn of 70 den./24 fil. having a twist of 13 turns per meter were concurrently processed under the following conditions to produce a textured mixed yarn: both yarns were fed to the first rollers at the same speed of 100 m/min; the first overfeed of 20 percent, the air pressure of 3.5 kg/cm², the temperature of the heater being 180°C, with other conditions remaining substantially the same as in Example 4.

A textured mixed yarn having an appearance similar to that of the yarn prepared in Example 4 was obtained. The mixed yarn had the following properties: tensile strength of 2.7 g/den., percent of crimping being 14 percent, 14 protruding filament ends/cm, the average length of fibers being 8 mm, 5 loops/cm and 0.6 coils per cm.

What we claim is:

1. A process for manufacturing a bulky, crimped thermoplastic polymer multifilament yarn, which comprises feeding a continuous multifilament yarn having a twist less than approximately 800 turns per meter to a high velocity fluid jet where a multitude of loops and arches are formed on the yarn surface and individual filaments are irregularly entangled with each other, and the subjecting the multifilament yarn to a combination of the steps of false twisting such that the whole multifilament yarn is false twisted, and of passing the multifilament yarn over a friction member thereby cutting at least some of the looped and arched filaments on the yarn surface to form filament ends.

2. The process according to claim 1 wherein said combination of steps of false twisting and passing the yarn over the friction member comprises false twisting the multifilament yarn and then passing the false twisted multifilament yarn over the friction member.

3. The process according to claim 1 wherein said combination of steps of false twisting and passing the yarn over the friction member comprises passing the multifilament yarn over the friction member and then false twisting the multifilament yarn.

4. The process according to claim 1 wherein said combination of steps of false twisting and passing the yarn over the friction member comprises passing the multifilament yarn over the friction member in the course of false twisting the multifilament yarn.

5. The process according to claim 1 wherein said step of feeding comprises supplying a multifilament yarn having substantially no twists to the high velocity fluid jet at an overfeed rate of 5 to 25 percent.

6. The process according to claim 1 comprising creating said high velocity fluid jet in a nozzle by supplying thereinto, air with a pressure of 2 to 7 kg/cm².

7. The process according to claim 1 wherein said step of passing filament yarn comprises passing the yarn over the friction member under a tension of at least 0.1 gram per denier.

8. The process according to claim 1 wherein said step of passing comprises passing the yarn over a friction member in the form of a rotor having a sandy surface and rotating at a speed in the range of 500 to 5,000 rpm.

9. A yarn made by the process defined in claim 1.

* * * * *